US006269147B1

(12) United States Patent
Powell

(10) Patent No.: US 6,269,147 B1
(45) Date of Patent: Jul. 31, 2001

(54) X-RAY EXAMINATION APPARATUS AND METHOD FOR ADJUSTING THE SAME

(75) Inventor: Martin J. Powell, Horley (GB)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/482,931

(22) Filed: Jan. 13, 2000

(30) Foreign Application Priority Data

Jan. 13, 1999 (GB) ..... 9900592

(51) Int. Cl.[7] ..... G21K 3/00
(52) U.S. Cl. ..... 378/158; 378/156
(58) Field of Search ..... 378/158, 159, 378/156, 157, 147

(56) References Cited

U.S. PATENT DOCUMENTS 5,148,465 * 9/1992 Mulder et al. ..... 378/156
5,559,853 * 9/1996 Linders et al. ..... 378/158
5,878,111 * 3/1999 Schulz ..... 378/158

FOREIGN PATENT DOCUMENTS

WO97.03450 1/1997 (WO) ..... G21K/3/00
WO-98/21729 * 5/1998 (WO) ..... G21K/3/00

* cited by examiner

*Primary Examiner*—Robert H. Kim
*Assistant Examiner*—Irakli Kiknadze
(74) *Attorney, Agent, or Firm*—John F. Vodopia

(57) ABSTRACT

An X-ray examination apparatus comprises an X-ray source, an X-ray detector (3) and an X-ray filter arranged between the X-ray source and the X-ray detector. The X-ray filter comprises a plurality of filter elements each comprising a vessel containing an X-ray absorbing liquid, the liquid level in each vessel determining the X-ray absorptivity of the respective filter element. Control means is provided for applying electric voltages to the individual filter elements to change the liquid levels within an adjust time period. The control means is arranged to apply a respective control voltage to each individual filter element a repeat number of times within the adjust time period, the repeat number being selected so as substantially to maximize the rate of change of liquid level of the filter elements. This enables patient examination times to be reduced, by reducing the times between sequential images.

9 Claims, 7 Drawing Sheets

X-RAY EXAMINATION APPARATUS AND METHOD FOR ADJUSTING THE SAME

BACKGROUND OF THE INVENTION

1. Field of the Invention

This invention relates to X-ray examination apparatus in which an X-ray filter is provided between an X-ray source and an X-ray detector. An object to be examined, for example a patient, is positioned between the X-ray filter and the detector.

2. Description of Related Art

Apparatus of this type is described in WO 97/03450.

The filter used in such an apparatus enables an X-ray image to be obtained with a low dynamic range. This is desirable so that small details of the X-ray image, which occur as small variations in contrast, may be analysed. This is possible by using the filter to block signals which would give rise to a larger dynamic range. Some parts of the body, for example lung tissue, have very high X-ray transmittance whereas other parts of the body, for example bone tissue, can hardly be penetrated by X-rays. Without filtering, this difference gives rise to the large dynamic range. The reduction in dynamic range achievable using a two-dimensionally controllable X-ray filter simplifies image intensifying techniques for the detected image. The ability to shield certain areas of the body using the filter may also be desirable to protect certain types of body tissue from X-ray exposure.

The filter described in WO 97/03450 comprises an array of capillary tubes, each containing an X-ray absorbing liquid, and the height of the liquid in each tube is controllable to provide a different degree of X-ray absorption. WO 97/03450 describes a method of controlling the level of liquid in each capillary by applying a given fixed voltage signal over a different time period for different capillaries. The change in liquid level as a function of time is used as a control parameter. The capillaries are arranged in rows and columns, and the capillaries are addressed row by row. It has also been proposed that the filter adjustment should be divided into a number of time frames so that the liquid level of each row may be adjusted in partial stages. This has been considered desirable because the physical inertia of the liquid is considered to favour liquid movement in discrete steps. Furthermore, a smaller time difference then exists between the filling of capillaries in the first rows and those in the last rows. This may enable imaging to be started during the latter stages of the filter adjustment period A problem which is not addressed by WO 97/03450 is the need to reduce the overall time required to adjust the X-ray filter from one configuration to a new configuration. The time required to change the liquid level in an individual filter element is not only a function of the physical inertia of the X-ray absorbing liquid, but also is a function of the effective electrical capacitance of the filter elements, which varies as the liquid level varies.

Citation of a reference herein, or throughout this specification, is not to construed as an admission that such reference is prior art to the Applicant's invention of the invention subsequently claimed.

SUMMARY OF THE INVENTION

According to the present invention, there is provided an X-ray examination apparatus comprising an X-ray source, an X-ray detector and an X-ray filter arranged between the X-ray source and the X-ray detector, the X-ray filter comprising a plurality of filter elements each comprising a vessel containing an X-ray absorbing liquid, the liquid level in each vessel determining the X-ray absorptivity of the respective filter element, wherein control means is provided for applying electric voltages to the individual filter elements to change the liquid levels within an adjust time period, wherein the control means is arranged to apply a respective control voltage to each individual filter element a repeat number of times within the adjust time period, the repeat number being selected so as substantially to maximise the rate of change of liquid level of the filter elements.

The apparatus of the invention controls the signals driving the individual filter elements in such a way that the rate of change of liquid level of the filter elements may be maximised. This may enable the adjust time to be reduced so that sequential images (for example at different angles through the patient) may be taken with a shorter interval between images, thereby reducing the overall examination time.

Each filter element preferably comprises a capillary tube, with the liquid in each filter element coupled to a common reservoir. This common reservoir then acts as a virtual earth, and each capillary acts as a capacitor coupled to earth, with the capacitance being a function of the liquid level.

The adjust time period may be between 100 ms and 200 ms, and the repeat number may be between 20 and 50.

The invention also provides a method of adjusting an X-ray examination apparatus, comprising the adjustment of the X-ray absorptivity of the filter elements of an X-ray filter by controlling a quantity of X-ray absorbing liquid within individual filter elements, wherein control voltages are applied to the individual filter elements to control the level of the X-ray absorbing liquid within the filter elements during an adjust time period within which the X-ray filter is to be adjusted, wherein respective control voltages are applied to each individual filter element a repeat number of times during the adjust time period, the repeat number being selected so as substantially to maximise the rate of change of liquid level of the filter elements.

BRIEF DESCRIPTION OF THE DRAWING

The invention will now be described by way of example, with reference to the accompanying drawings, in which.

DETAILED DESCRIPTION OF THE PREFERRED EMBODIMENT

Figure 1:
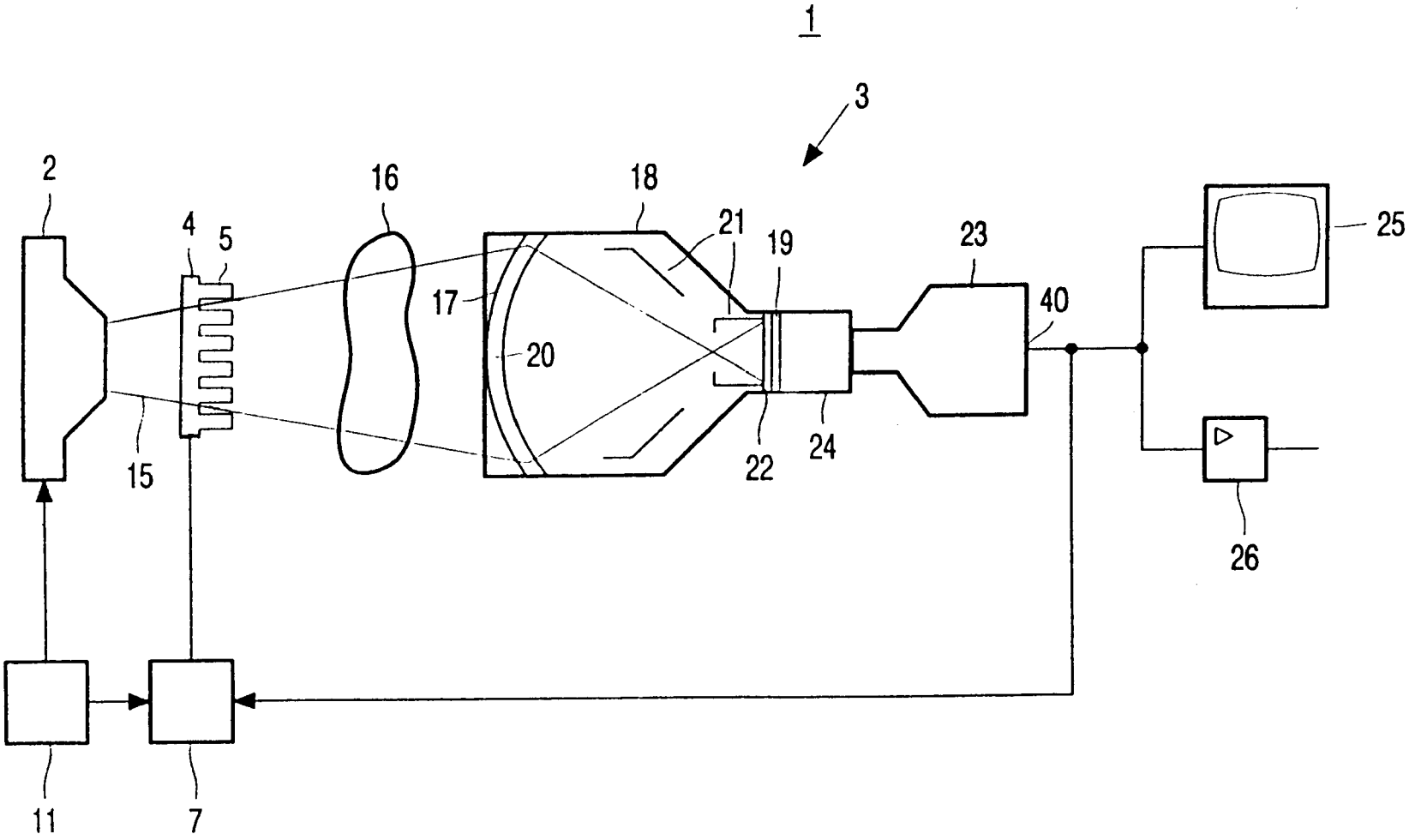
FIG. 1 shows an X-ray examination apparatus which may be controlled in accordance with the invention.

FIG. 1 shows diagrammatically an X-ray examination apparatus 1 in accordance with the invention. An X-ray source 2 emits an X-ray beam 15 for irradiating an object 16. Differences in X-ray absorption within the object 16, for example a patient to be radiologically examined, give rise to an X-ray image formed on an X-ray sensitive surface 17 of the X-ray detector 3, which is arranged opposite the X-ray source. The X-ray detector 3 of the present embodiment is formed by an image intensifier pick-up chain which includes an X-ray image intensifier 18 for converting the X-ray image into an optical image on an exit window 19 and a video camera 23 for picking up the optical image. The entrance screen 20 acts as the X-ray sensitive surface of the X-ray image intensifier which converts X-rays into an electron beam which is imaged on the exit window by means of an electron optical system 21. The incident electrons generate the optical image on a phosphor layer 22 of the exit window 19. The video camera 23 is coupled to the X-ray image intensifier 18 by way of an optical coupling 24, for example a lens system or a fiber-optical coupling. The video camera 23 extracts an electronic image signal from the optical image, which signal is applied to a monitor 25 for the display of the image information in the X-ray image. The electronic image signal may also be applied to an image processing unit 26 for further processing.

Between the X-ray source 2 and the object 16 there is arranged the X-ray filter 4 for local attenuation of the X-ray beam. The X-ray filter 4 comprises a large number of filter elements 5 in the form of capillary tubes whose X-ray absorptivity can be adjusted by application of an electric voltage, referred to hereinafter as adjusting voltage, to the inner side of the capillary tubes by means of the adjusting unit 7. The adhesion of the X-ray absorbing liquid to the inner side of the capillary tubes is adjusted by means of this electric voltage. One end of the capillary tubes communicates with a reservoir for an X-ray absorbing liquid. The capillary tubes are filled with a given quantity of X-ray absorbing liquid as a function of the electric voltage applied to the individual tubes. Because the capillary tubes extend approximately parallel to the X-ray beam, the X-ray absorptivity of the individual capillary tubes is dependent on the relative quantity of X-ray absorbing liquid in such a capillary tube.

The electric adjusting voltage applied to the individual filter elements is adjusted by means of the adjusting unit 7, for example on the basis of brightness values in the X-ray image and/or the setting of the X-ray source 2. For this purpose, the adjusting unit 7 is coupled to the output terminal 40 of the video camera and to the power supply 11 of the X-ray source 2. The construction of an X-ray filter 4 of this kind and the composition of the X-ray absorbing liquid are described in detail in International Patent Application WO 96/13040.

Figure 2:
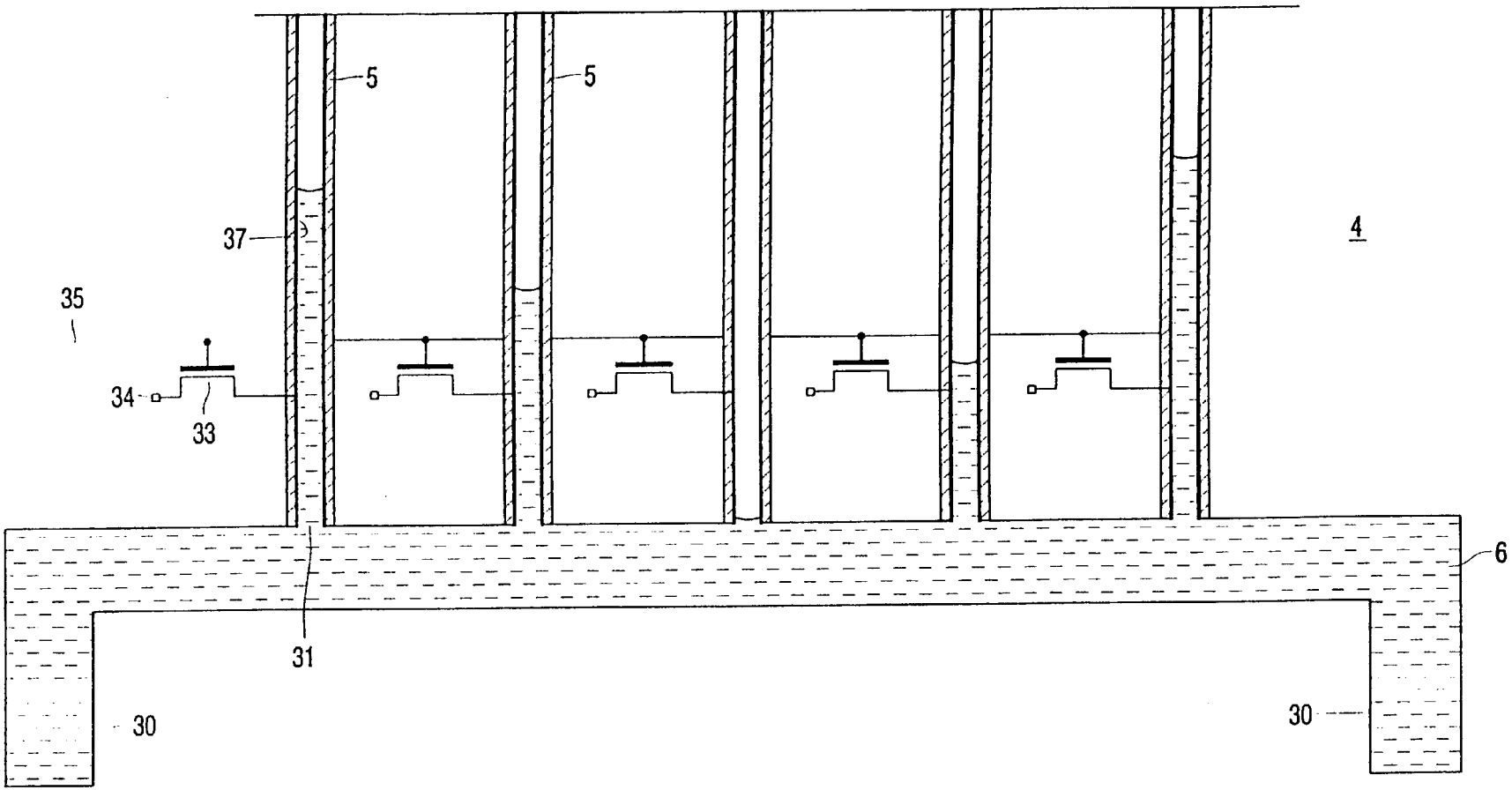
FIG. 2 shows in greater detail the X-ray filter of the apparatus shown in FIG. 1.

FIG. 2 is a side elevation of an X-ray filter 4 of the X-ray examination apparatus of FIG. 1. The Figure shows seven capillary tubes by way of example, but a practical embodiment of an X-ray filter 4 of an X-ray examination apparatus in accordance with the invention may comprise a large number of capillary tubes, for example 40,000 tubes in a 200×200 matrix arrangement. Each of the capillary tubes 5 communicates at one end 31 with the X-ray absorbing liquid 6 in the reservoir 30. The X-ray absorbing liquid comprises, for example, an aqueous solution of a lead salt, such as lead perchlorate, lead nitrate, lead chlorate-hydrate, lead acetate-trihydrate or lead dithionate. A solution of uranium salts, such as uranylchloride, uranium tetrabromide or uranium tetrachloride dissolved in water are also suitable.

The inner side of the capillary tubes is covered by an electrically conductive layer 37, for example of gold or platinum, which layer 37 is coupled to a voltage line 34 via a switching element 33.

For application of the electric adjusting voltage to the electrically conductive layer 37 of a capillary tube, the relevant switching element 33 is closed while the voltage line 34 is supplied with the desired electric adjusting voltage. The switching elements are driven by a control line 35. When brief voltage pulses having a length of a few tens of microseconds are used, adjusting voltages in a range of from 0 V to 400 V can be used. In this voltage range, switches in the form of $\alpha$-Si thin-film transistors can be used. Preferably, an adjusting voltage in the range of from 0 V to 100 V is used. Because the voltage pulses are so brief, the application of the adjusting voltage does not cause any, or hardly any, electrolysis of the lead salt solution used as the X-ray absorbing liquid.

The X-ray absorptivity of the individual capillary tubes can be controlled on the basis of the level of the electric adjusting voltage applied to the capillary tubes. Each of the capillary tubes, notably the conductive layer 37 and the X-ray absorbing liquid in the capillary tube, constitutes a capacitor. During the filling of such a capillary tube with the X-ray absorbing liquid, the capacitance varies as a function of the level of the liquid in the capillary tube.

On the electrically conductive layer there is preferably provided a dielectric layer of a thickness sufficient to ensure that the electric capacitance of the capillary tubes remains low enough to enable fast response to the application of the electric voltage. However, the shorter the switch on time, the more significant becomes the electrical response time of the capillaries. A coating layer having suitable hydrophilic/hydrophobic properties may also be provided on the dielectric layer.

Figure 3:
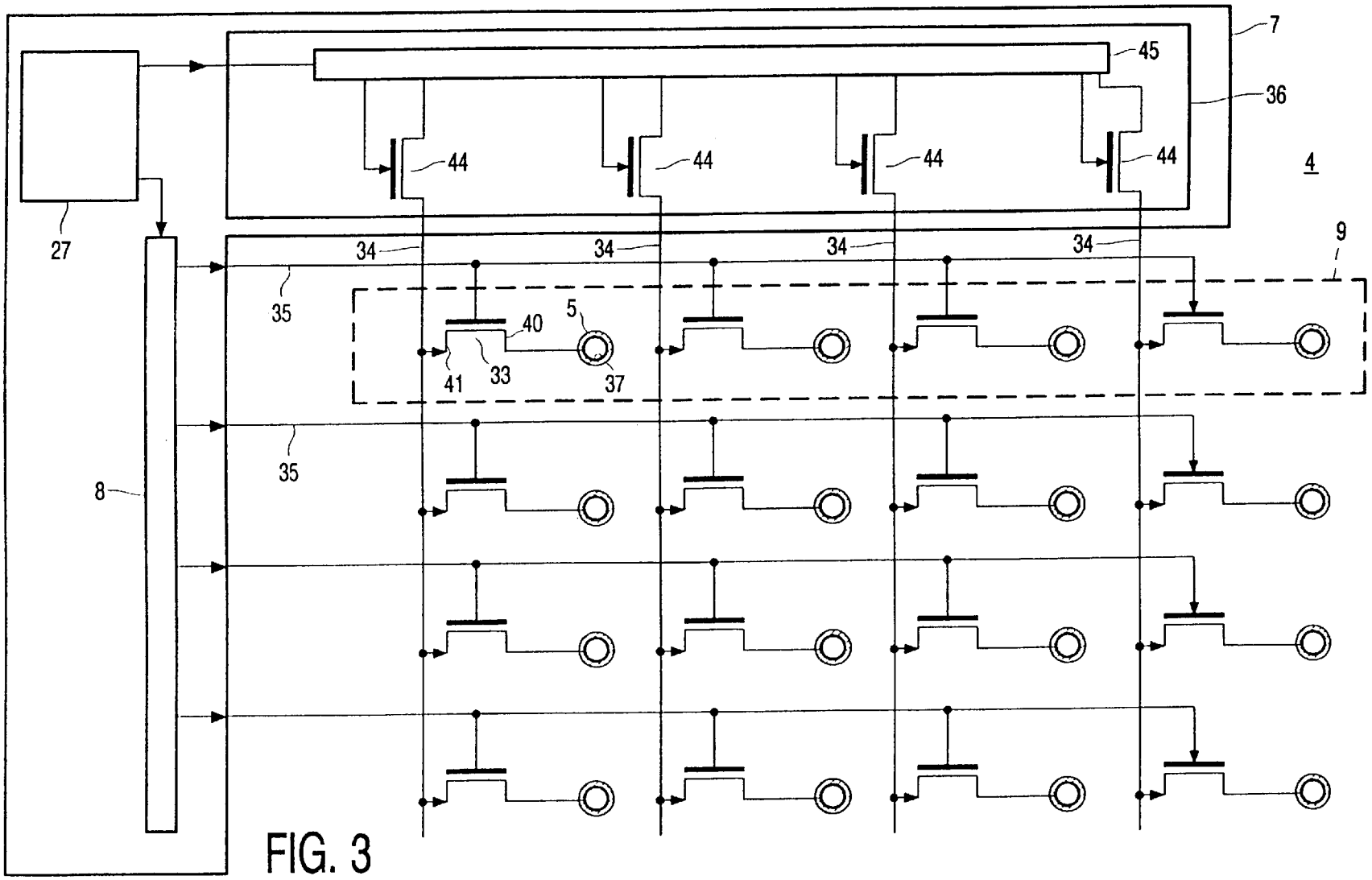
FIG. 3 shows the filter of FIG. 2 together with control circuitry.

FIG. 3 is a plan view of an X-ray filter 4 of the X-ray examination apparatus shown in FIG. 1. An X-ray filter 4 comprising 16 capillary tubes in a 4×4 matrix arrangement is shown by way of example. However, in practice the X-ray filter 4 may comprise a much larger number of capillary tubes, for example 200×200 tubes. Each of the capillary tubes is coupled, by way of the electrically conductive layer 37, to the drain contact 40 of a field effect transistor 33 which acts as a switching element and whose source contact 41 is coupled to a voltage line. For each row 9 of capillary tubes there is provided a control line 35 which is coupled to the gate contacts of the field effect transistors in the relevant row in order to control the field effect transistors in this row. The control line 35 of the relevant row is energized by an electric control voltage pulse in order to enable an adjusting voltage to be applied to the electrically conductive inner side of the capillary tubes in the row. During the control voltage pulse, the field effect transistors in the relevant row are electrically turned on.

The adjusting unit 7 comprises a voltage generator 27 for applying an electric voltage to the timer unit 8 which applies the control voltage pulses having the desired duration to the individual control lines of the rows of capillary tubes. The timer unit comprises a row addressing circuit using conventional components to enable each row to be sequentially selected. While the relevant field effect transistors are turned on, i.e. the switching elements are closed, the electric adjusting voltage of the relevant control lines 34 is applied to the capillary tubes. The level of the adjusting voltage applied to individual capillary tubes in a row can be differentiated by application of the different electric adjusting voltages to the respective voltage lines 34 of individual columns. To this end, the adjusting unit 7 comprises a column driver 36 which controls the application of the electric adjusting voltage generated by the voltage generator 27 to the individual voltage lines. Each of the voltage lines 34 is coupled to a respective switching element, for example a transistor 44. When the transistor 44 of the voltage line 34 is turned on by energizing the gate contact of the relevant transistor by means of a gate voltage, the adjusting voltage is applied to the voltage line. The gate contacts of the transistors 44 are coupled, via a control unit 45, to the voltage generator 27 which supplies the gate voltage. The adjusting voltages are also generated by the voltage generator 27 and the application of these voltages to the voltage lines is also controlled by the control unit 45.

Figure 4:
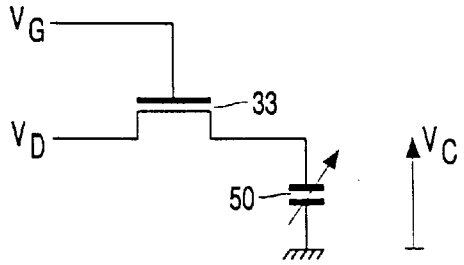
FIG. 4 shows an equivalent circuit for an individual filter element shown in FIG. 3.

FIG. 4 shows an equivalent electrical circuit for an individual capillary. A gate voltage $V_G$ is supplied by the control line 35 to switch the transistor on when a particular row of capillaries is to be addressed. The control voltage, from the voltage line 34, is supplied as the drain voltage $V_D$ which is switched to the capillary by the transistor 33. The capillary itself is represented as a variable capacitor 50, the capacitance of which is a function of the liquid level in the capillary.

For the following analysis it is assumed that a total adjust period of 150 ms is available, and the graphs of FIGS. 5–8 show different control schemes for driving an individual capillary from an empty to a full state.

Figure 5:
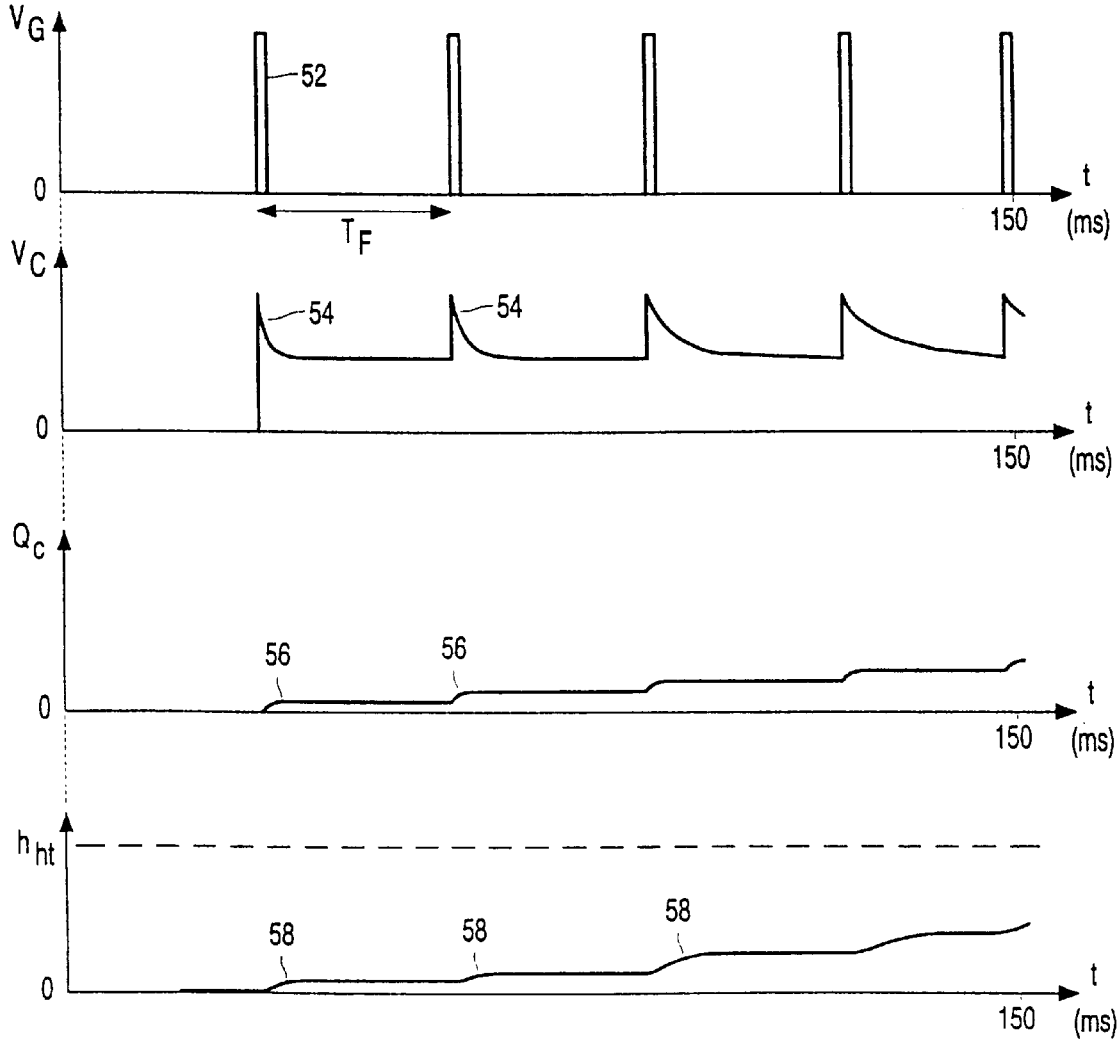
FIG. 5 shows an analysis of the circuit of FIG. 4 using a first control scheme.

In FIG. 5, a frame time of $T_f$ of 30 ms has been selected. This time period corresponds to the time during which all rows of capillaries are addressed in turn. The width of the address pulse $V_G$ is therefore determined by dividing the frame time $T_f$ by the number of rows, and reducing further the pulse width to take account of the rise time and the fall time and any guard times which ensure that the addressing of different rows does not overlap. Assuming the capillary in question is in the last row, the first gate pulse will appear at the end of the first frame period, and such a capillary is considered in FIGS. 5–8. The frame period of 30 ms gives the possibility of providing five repeats within the allowed adjust period of 150 ms.

During each gate pulse 52, the capacitor is charged to the control voltage on the drain $V_D$ (less the source to drain voltage of the transistor 33). The relatively wide gate pulses 52 in FIG. 5 enable the capacitor 50 to be charged by the control voltage. However, as charge is transferred to the capacitor, the capacitance changes, and this change in capacitance results in a fall in the voltage across the capillary capacitor 50. Consequently, there is a voltage peak for the voltage $V_C$ on the capacitor initially, and this voltage drops as the liquid level rises. This gives rise to the peaks 54 as shown. Each peak 54 corresponds to an increment 56 in the charge stored on the capacitor $Q_C$ corresponding to a liquid level rise 58.

During each gate address pulse 52 there is a maximum amount of charge which can be transferred to the capacitor representing the capillary. This amount of charge is a function of the capacitance at that time and the control voltage being applied. This explains the incremented rise in charge $Q_C$ on the capacitor and the corresponding incremental rise in the liquid height level h. The small number of repeats in FIG. 5 do not allow sufficient movement of charge on to the capillary capacitor to obtain a full capillary, reaching a target height $h_t$.

Figure 6:
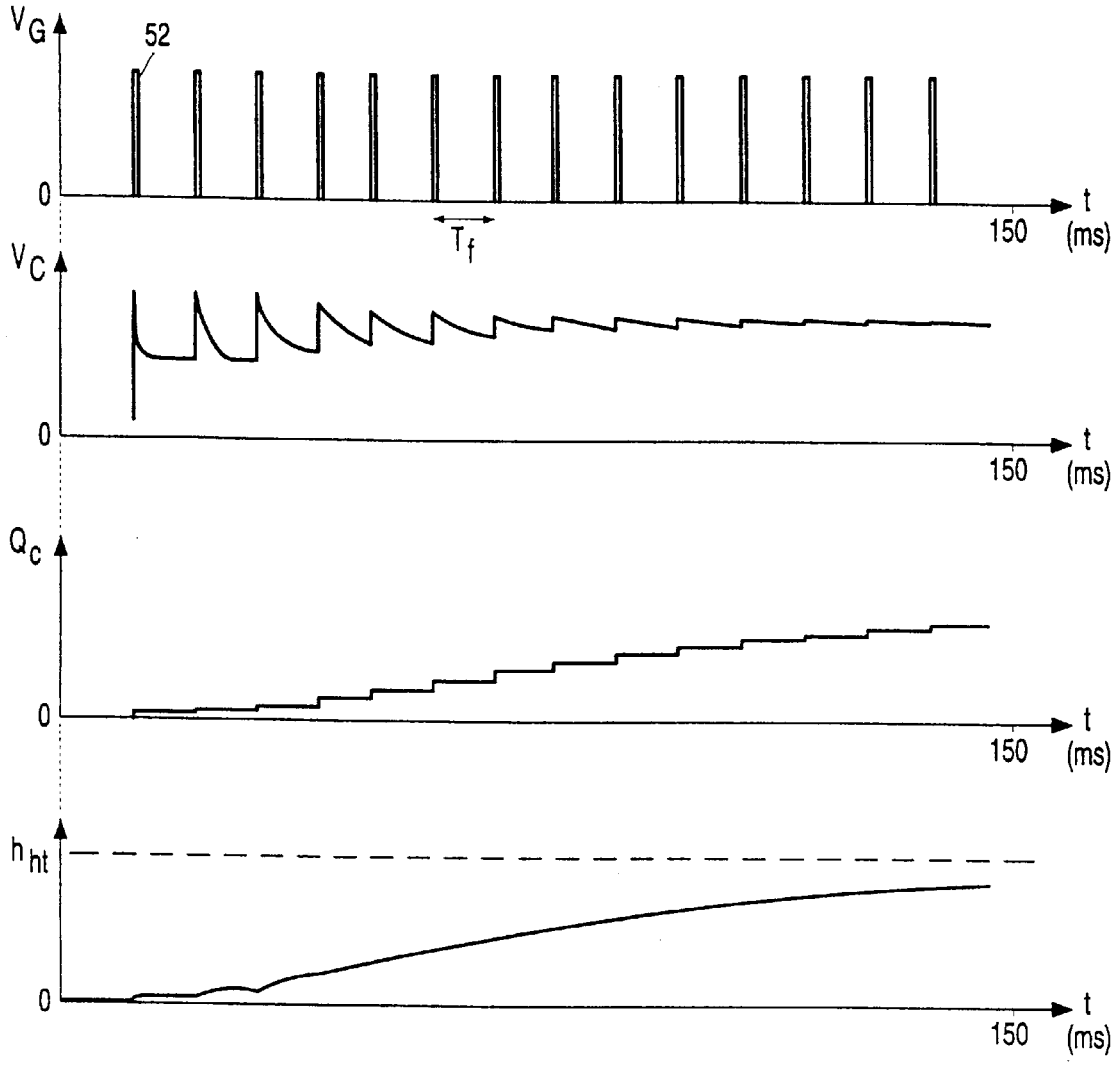
FIG. 6 shows an analysis of the circuit of FIG. 4 using a second control scheme.

The number of repeats has been increased in the analysis of FIG. 6, giving rise to a frame time $T_f$ of approximately 10 ms. The gate pulses 52 are correspondingly shorter in duration and the effect of this is that the pulses 52 may not be sufficiently long to enable the full transfer of charge from the control line to the capillary capacitor 50. The charge stored on the capacitor $Q_C$ therefore rises in smaller increments, and the height of liquid in the capillary will rise with corresponding smaller increments. However, these increments are much closer together in time, so that the overall effect is an increase in the rate of liquid rise in the capillary. In the example of FIG. 6, the liquid in the capillary reaches the target height $h_t$ at approximately the end of the 150 ms adjust period.

Figure 7:
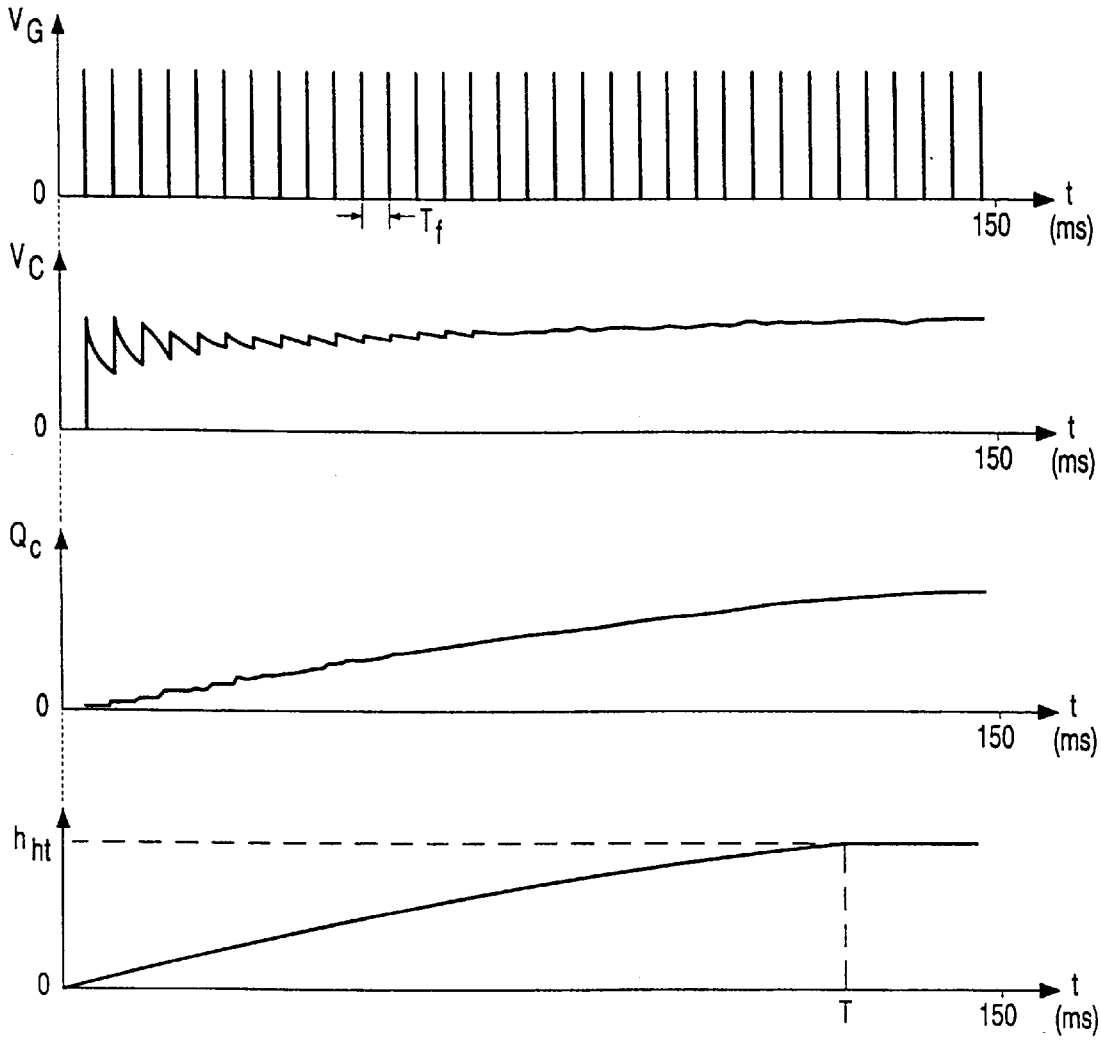
FIG. 7 shows an analysis of the circuit of FIG. 4 using a third control scheme.

FIG. 7 shows a further increase in the number of repeats, giving rise to a frame time of approximately 4 ms. Based on the capillary capacitance used for this particular analysis, this enables the liquid height to reach the target $h_t$ some time before the end of the adjust period.

Figure 8:
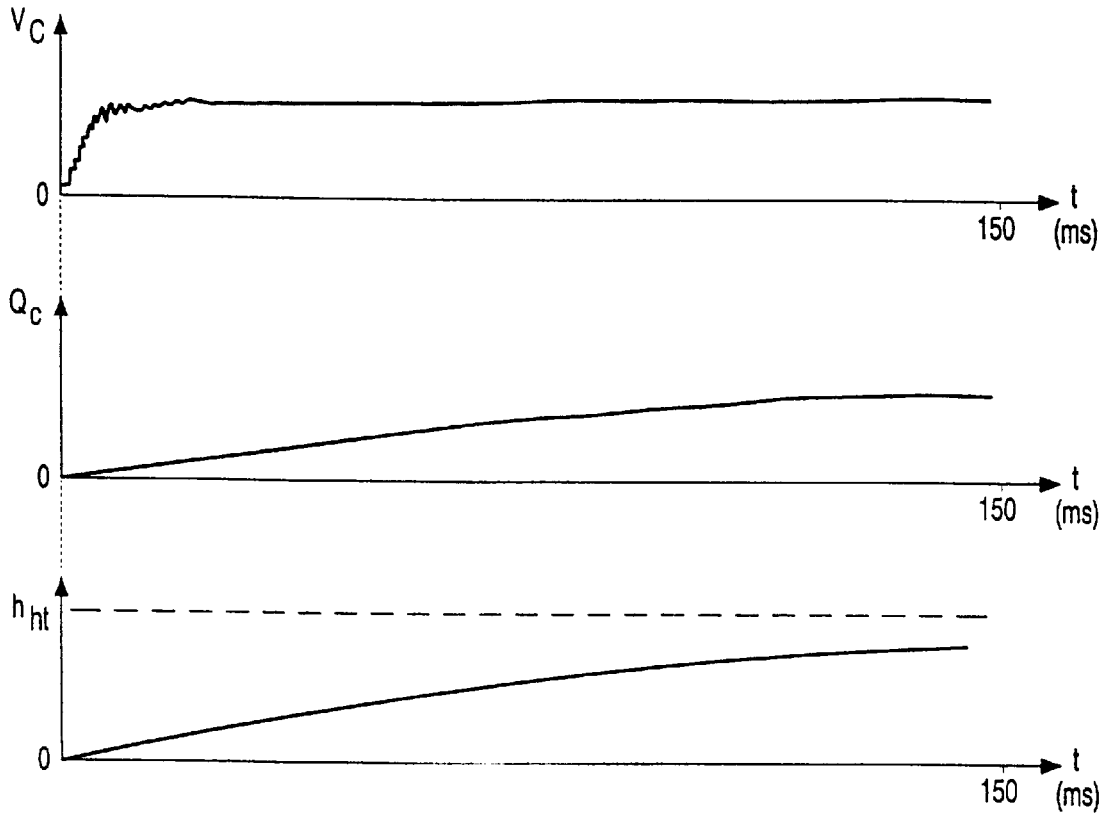
FIG. 8 shows an analysis of the circuit of FIG. 4 using a fourth control scheme.

Incrementing the number of repeats further, for example to a frame time of 1 ms which is represented in FIG. 8, reduces the rate of liquid rise in the capillary, because insufficient time is available during each gate pulse (not shown in FIG. 8) to transfer significant charge to the capillary capacitor 50.

It can be seen, therefore, that there exists an optimum frame time and therefore an optimum number of repeats for a given system configuration. This optimum will depend upon the electrical properties of the capillary and the addressing circuitry, and can be determined by modelling, for example in the manner shown with reference to FIGS. 4–8, or by experimentation. An X-ray apparatus operating in accordance with the invention is calibrated to perform adjustment of the liquid levels in the capillaries using a frame time and therefore a repeat number for which the rate of liquid movement in the capillaries is maximised. In the example described, this takes place with a frame time of approximately 4 ms, and which gives rise to approximately 35 repeats within the overall adjust time of 150 ms.

Whilst the repeat number has been described above as the parameter which is selected to obtain the desired maximum rate of charge of liquid level, it will be appreciated by those skilled in the art that the repeat number, the frame time and the overall adjust time and the width of the gate pulse are all interrelated, and any of these parameters may be selected as the control parameter. Each possibility is intended to fall within the scope of this invention.

The functions of the adjusting unit are preferably executed by a suitable programmed computer or by a microprocessor designed for this purpose.

Although a specific capillary design has been described in detail, the invention is applicable to different designs of vessel, in which the liquid level influences the electrical characteristics of the control circuitry.

All references cited herein, as well as the priority document British Patent Application 9900592.8 filed Jan. 13, 1999, are incorporated herein by reference in their entirety and for all purposes to the same extent as if each individual publication or patent or patent application was specifically and individually indicated to be incorporated by reference in its entirety for all purposes.

What is claimed is:

1. An X-ray examination apparatus comprising an X-ray source, an X-ray detector and an X-ray filter arranged between the X-ray source and the X-ray detector, the X-ray filter comprising a plurality of filter elements each comprising a vessel containing an X-ray absorbing liquid, the liquid level in each vessel determining the X-ray absorptivity of the respective filter element, wherein control means is provided for applying electric voltages to the individual filter elements to change the liquid levels within an adjust time period, wherein the control means is arranged to apply a respective control voltage to each individual filter element a repeat number of times within the adjust time period, the repeat number being selected so as substantially to maximise the rate of change of liquid level of the filter elements.

2. An apparatus as claimed in claim 1, wherein each filter element comprises a capillary tube.

3. An apparatus as claimed in claim 2, wherein the liquid in each filter element is coupled to a common reservoir.

4. An apparatus as claimed in claim 2, wherein the respective control voltage is applied to an inner surface of the capillary.

5. An apparatus as claimed in claim 4, wherein the control means comprises, for each filter element, a switching device having an input for the control voltage, an output connected to the inner surface of the capillary and a gate line which controls the switching of the signal from the input to the output.

6. An apparatus as claimed in claim 5, wherein the filter elements are arranged in rows and columns, with each row sharing a gate line, the gate lines of different rows being turned on at different times within the adjust time, and each the repeat number of times.

7. An apparatus as claimed in claim 1, wherein the predetermined adjust time period is between 100 ms and 200 ms and repeat number between 20 and 50.

8. A method of adjusting an X-ray examination apparatus, comprising the adjustment of the X-ray absorptivity of the filter elements of an X-ray filter by controlling a quantity of X-ray absorbing liquid within individual filter elements, wherein control voltages are applied to the individual filter elements to control the level of the X-ray absorbing liquid within the filter elements during an adjust time period within which the X-ray filter is to be adjusted, wherein respective control voltages are applied to each individual filter element a repeat number of times during the adjust time period, the repeat number being selected so as substantially to maximise the rate of change of liquid level of the filter elements.

9. A method as claimed in claim 8, wherein the adjust time period is between 100 ms and 200 ms and repeat number is between 20 and 50.

* * * * *